US009126720B2

(12) United States Patent
Gast

(10) Patent No.: US 9,126,720 B2
(45) Date of Patent: Sep. 8, 2015

(54) SNAP-FOLD CONTAINERS

(71) Applicant: Mandarin Associates Ltd., Kowloon (HK)

(72) Inventor: Barro de Gast, Purmerend (NL)

(73) Assignee: Mandarin Associates Ltd., Kowloon (HK)

( * ) Notice: Subject to any disclaimer, the term of this patent is extended or adjusted under 35 U.S.C. 154(b) by 0 days.

(21) Appl. No.: 14/157,001

(22) Filed: Jan. 16, 2014

(65) Prior Publication Data

US 2014/0197167 A1 Jul. 17, 2014

Related U.S. Application Data

(60) Provisional application No. 61/753,325, filed on Jan. 16, 2013.

(51) Int. Cl.

| | |
|---|---|
| ***B65D 6/18*** | (2006.01) |
| ***B65D 6/16*** | (2006.01) |
| *B65D 5/36* | (2006.01) |
| *B65D 5/02* | (2006.01) |
| *B65D 5/20* | (2006.01) |

(52) U.S. Cl.

CPC ..... *B65D 11/1833* (2013.01); *B65D 11/18* (2013.01); *B65D 5/0209* (2013.01); *B65D 5/2023* (2013.01); *B65D 5/2057* (2013.01); *B65D 5/3685* (2013.01)

(58) Field of Classification Search

CPC ..... B65D 11/1833; B65D 5/42; B65D 5/36; B65D 5/3685; B65D 5/4266; B65D 5/4208; B65D 5/2023; B65D 5/2057; B65D 5/0209; B65D 11/18

USPC ..... 220/6, 666, 7, 62, 826; 229/103.3, 229/116.1, 150

See application file for complete search history.

(56) References Cited

U.S. PATENT DOCUMENTS

| | | | | |
|---|---|---|---|---|
| 2,586,612 | A * | 2/1952 | Caldwell | 4/657 |
| 3,630,430 | A | 12/1971 | Struble | |
| 3,845,897 | A | 11/1974 | Buttery et al. | |
| 4,678,095 | A * | 7/1987 | Barnett et al. | 220/4.21 |
| 5,699,926 | A * | 12/1997 | Jacques et al. | 220/6 |
| 8,286,828 | B2 * | 10/2012 | Schafer | 220/826 |
| 2006/0060522 | A1 * | 3/2006 | Bushey | 210/470 |
| 2009/0072015 | A1 * | 3/2009 | Drew et al. | 229/102 |

* cited by examiner

*Primary Examiner* — Stephen Castellano
(74) *Attorney, Agent, or Firm* — Lowe Graham Jones PLLC

(57) ABSTRACT

The invention disclosed includes various durable containers constructed from sheet materials including a plurality of living hinges. The containers are configured to snap into an assembled position from a relatively flat position by the application of pressure to one or more sidewalls wherein that pressure deforms the one or more sidewalls into a concave position, thereby holding the container into place until the contain is collapsed once again for storage or cleaning.

10 Claims, 17 Drawing Sheets

SNAP-FOLD CONTAINERS

PRIORITY CLAIM

This application claims the benefit of U.S. provisional application Ser. No. 61/753,325 filed Jan. 16, 2013, the contents of which are hereby incorporated by reference.

FIELD OF THE INVENTION

This invention generally relates to folding containers, particularly including containers that are formed from flat sheet material and fold to form a three-dimensional container.

BACKGROUND OF THE INVENTION

In retail sales, including and especially those pertaining to gifts, electronics, and food items, there is a need for packaging design that is inexpensively manufactured and storable in a flattened condition until ready for use. In such environments, the flattened packaging design must be easily assembled with minimal effort and the packaging design must provide an interior holding compartment for storing an item, protecting the item from significant damage resulting from an impact of the kind experienced during shipping or handling.

In housewares, including and especially those pertaining to kitchen and bathroom containers, there is a need for durable container design that serves a practical function in the kitchen or bathroom, such as the function of collecting garbage, holding washed dishware for drying, or straining pasta or vegetables. Containers for these purposes must be easily cleaned and stored and they often require handles for easy transportation, filling, and emptying. There is also a need to minimize the amount of space required for storage of such containers when the container is not in use given that storage space in most kitchens and bathrooms is limited.

Therefore, the invention as disclosed herein pertains generally to a container design that combines various attributes desirable for use in retail sales or in kitchens and bathrooms, or in other fields of use where the claimed containers would provide value. Particularly, the invention as disclosed herein combines the attributes of inexpensive manufacture, durability, collapsibility, and ease of assembly with minimal effort.

SUMMARY OF THE INVENTION

The invention is generally in the form of a collapsible container configured with fold lines enabling the container to expand and hold its position in the expanded configuration.

One version of the invention is a collapsible container constructed from a single sheet of material comprising first, second, third, and fourth sidewalls, wherein the first sidewall is provided opposite the third sidewall and the second sidewall is provided opposite the fourth sidewall; wherein the invention further comprises a substantially planar bottom surface; an interior compartment surrounded on four sides by said first, second, third, and fourth sidewalls and on the bottom by said substantially planar bottom surface; and at least three living hinges integrally formed in each of said first, second, third, and fourth sidewalls, wherein the living hinges are positioned in a manner permitting the container to be easily snapped into an assembled position.

Another example of the invention further comprises a collapsible container constructed from a single sheet of material comprising first, second, third, and fourth sidewalls, wherein the first sidewall is provided opposite the third sidewall and the second sidewall is provided opposite the fourth sidewall; a substantially planar bottom surface; an interior compartment defined on four sides by said first, second, third, and fourth sidewalls and on the bottom by said substantially planar bottom surface; wherein the single sheet of material forming the cover is a polymer plastic material; and wherein the single sheet of material includes at least six living hinges.

In another version, the invention comprises a snap-fold kitchen implement comprising first, second, third, and fourth sidewalls, wherein the first sidewall is provided opposite the third sidewall and the second sidewall is provided opposite the fourth sidewall; wherein the first and third sidewalls snap into a concave position when the kitchen implement is assembled and wherein the second and fourth sidewalls are disposed generally parallel to each other when the kitchen implement is assembled; and wherein the snap-fold kitchen implement includes a plurality of holes to facilitate water drainage.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

In the versions of the invention that follow, three dimensional containers are formed from flat sheet material that is folded along living hinges to produce sidewalls and other structural members as desired. In many cases, living hinges are incorporated to have curvature or angles that are other than right angles in order to form convex or concave sidewalls that are prone to holding their shape. At the same time, application of an opposing force can pop the walls out of their rigid upright state and into a flattened, i.e., "collapsed" position. The containers according to the present invention are sometimes referred to as "snap-fold" containers because the fold along pre-stressed locations and can produce a snapping sound as they are forced into an expanded position.

Figure 1A:
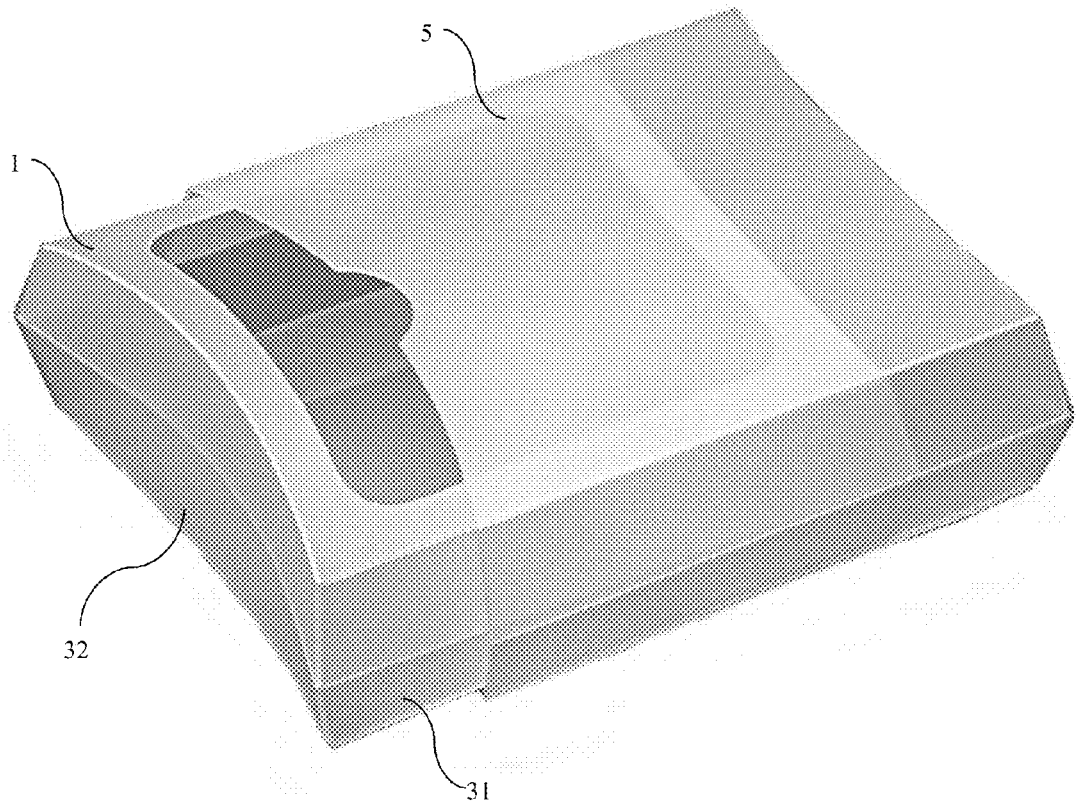
FIG. 1A is a perspective view of a snap-fold container and cover made in accordance with principles of the invention.

As shown in FIG. 1A, a first version of the invention is a snap-fold slide box, as described further below. The slide box includes two components, including the box 1 and its cover 5. The box is formed from flat stock material cut into a shape that allows the flat stock material to be folded to form the box.

Figure 1B:
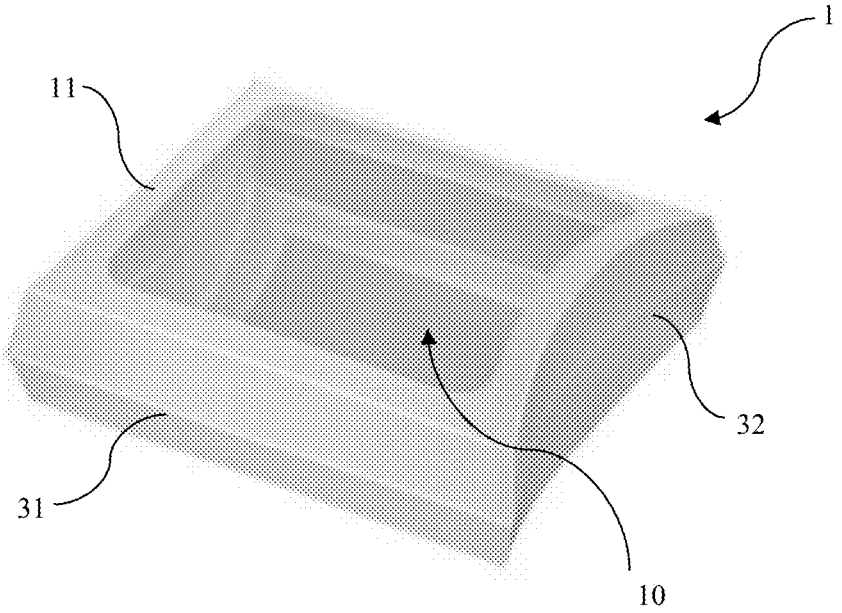
FIG. 1B is a perspective view of a snap-fold container made in accordance with principles of the invention.
Figure 1C:
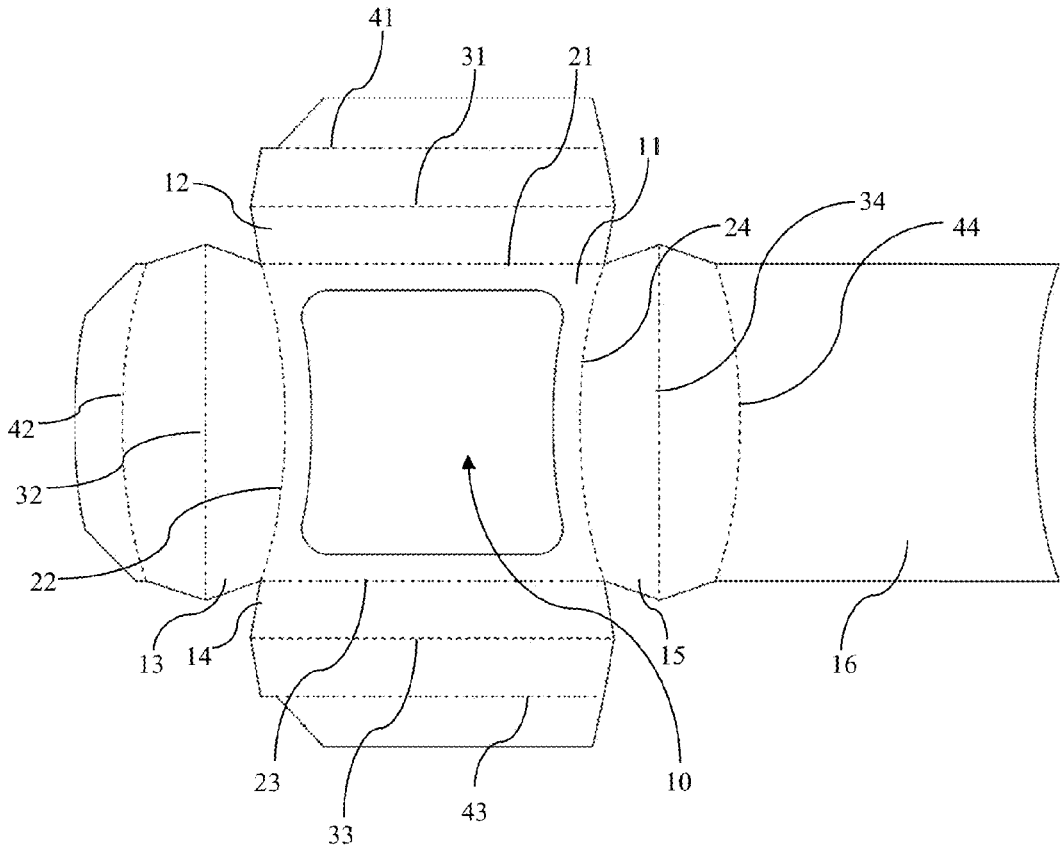
FIG. 1C is a plan view of an unassembled snap-fold container made in accordance with principles of the invention.

In the version as shown in FIG. 1B, the box 1 includes a central opening 10 cut to allow the box to form an upper rim 11 and opening for receiving items to be stored in the box. In the same fashion, if the lid is removed, the box portion may serve as a bowl or similar such open-topped container. Other portions of the stock material (best seen in FIG. 1C, folded flat) serve as a first sidewall 12, a second sidewall 13, a third sidewall 14, a fourth sidewall 15, and a floor 16. As shown, each of the four sidewalls is integrally formed from the same material and therefore attached to a respective one of the four sides forming the top of the box. In the illustrated version the box is substantially square (though with two of the opposing sides that are bowed inward); in other versions it may be rectangular or otherwise shaped, including modified geometric shapes such as a hexagonal shape with inwardly bowed sides. Likewise, the slide box and other containers as described below may be used for a wide variety of intended purposes, such as holding eyewear, food items, clothing, office materials, electronics items, or others.

The flat or "sheet" stock material used to form the box is preferably a plastic material of a type and thickness that will retain substantial rigidity even when formed from relatively thin panels. Suitable sheet materials include polymer plastic materials including polypropylene. Plastic material injection molding processes may also be used to form the initially flat template prior to folding into a three dimensional shape. In other versions, the stock material may be cardstock, cardboard, or other paper-based materials.

The upper rim 11 forming the box adjoins the four sidewalls, in which two of the top corners adjoining the sidewalls at the rim 11 are comprised of living hinges 21 and 23 and are substantially straight at the intersection of the sidewalls 12 and 14 with rim 11, while the other two opposing corners comprised of living hinges 22 and 24 follow a path of curvature that is bowed inwardly and generally toward the center of the box, substantially at the middle of each of the sidewalls 13 and 15. In each case, the flat stock material is formed with living hinges in each of the locations where top corners formed by living hinges 21, 22, 23, and 24 are to be formed, thereby facilitating the transformation of the flat stock material into a three dimensional box. As noted above, a pair of opposing living hinges 21, 23 are substantially straight while a second pair of opposing living hinges 22, 24 are bowed inward.

Living hinges suitable for use in accordance with principles of the invention include those that are flexible or flexure bearing made from the same material as the two rigid pieces of material on either side of the hinge. Living hinges are typically formed by cutting, stamping, or otherwise weakening the material along the flexure point to enable bending at that point. Preferably the living hinge will be formed from material and in a manner that permits multiple uses over time in such a manner as to preserve the structural integrity of the container by protecting against substantial wear on the living hinge at the flexure point.

At about the midpoint of each sidewall, central living hinges 31, 32, 33, and 34 are formed such that they extend horizontally along the sidewall when the box is formed into its three dimensional shape. Thus, the stock material has four sidewall living hinges 31, 32, 33 and 34 positioned to be about half way between the top and the bottom of the sidewalls.

At the bottom of the sidewalls a bottom living hinge is provided. In the case of the opposing pair of straight sidewalls 12 and 14, the bottom living hinges 41, 43 are also straight and parallel to the top living hinges 21, 23 and middle living hinges 31, 33. In the case of the opposing pair of bowed sidewalls, the bottom living hinges 42, 44, the living hinge is bowed outward to follow a line of curvature that is substantially a mirror image of the top living hinges adjacent them.

In order to assemble the box, the flat stock material is folded at each of the living hinges to create a box with a top, four sidewalls, and a bottom. The distal portion of each sidewall, distant from the bottom living hinges, forms a plurality of flaps that are used for securing the sidewalls to the bottom of the box. In one version, such as that of FIG. 1C, the flaps may be sonic welded, glued, or otherwise permanently adhered to the bottom portion 15 of the box to permanently create an assembled box shape. In other versions, such as in FIG. 1D one or more tabs (e.g., 51, 52, 53) may be formed about the perimeter of one or more of the sidewalls and/or the bottom section, with complementary slots (e.g., 61, 62, 63) positioned to receive the tabs.

Once the ends are joined by inserting the tabs into the slots or gluing, welding or otherwise adhering them, it will generally form the shape of a box. Even in this form, however, the box may be flattened by folding the sidewalls along the middle sidewall living hinges 31, 32, 33, 34. To configure the box as an upright, rigid structure, the living hinges are pressed inward, generally toward the center of the box. More particularly, the pair of living hinges 32, 34 on the bowed sidewalls are pressed inward. This causes the bowed sidewalls to snap as they bow inward, forming a bowed shape along the upper living hinges 22, 24.

An optional slide box cover 5 is constructed so that it can be assembled to provide a sliding cover for the box 1 described above. As with the box 1, the cover is preferably formed from a flat sheet stock material such as a substantially rigid or semi-rigid plastic material. Thus, as shown in FIG. 1E, the flat sheet stock material is formed or cut into a shape having separate portions that define a box top 70, first sidewall 71, second sidewall 72, third sidewall 73, and bottom 74. The cover described above and as illustrated has only three sidewalls, leaving one side open to receive the box in a sliding fashion.

The flat sheet stock for the box cover further includes a series of living hinges, positioned substantially in the same locations as for the box. Likewise, the living hinges for the cover may be formed in the same manner, such as by stamping, heating, scoring, molding, or other processes to create weakened zones that serve as living hinges.

In order to serve as an open-sided cover, the cover includes opposing sides that are formed with straight living hinges at the juncture between the sidewalls and the top of the cover, and a curved living hinge at the top of the third sidewall. The curvature of the living hinge at the top of the third sidewall 73 follows a path of curvature that is the same as that incorporated into the opposing curved sidewall 13 for the box 1, as described above. Thus, when the box 1 is inserted into the cover 5, it is able to slide along the substantially straight sidewall sections 12 and 14 rather than along curved walls.

As with the box 1, the box cover 5 may be assembled from its flat stock material into a three dimensional cover by gluing, sonic welding, or otherwise adjoining lower flaps formed on the sidewalls to portions of the bottom section 74. In other versions, tabs and slots or other mechanical features and fasteners may be used.

Because the box cover has intermediate or central living hinges (as with the box), it can be flattened (i.e., collapsed) even in the assembled position. Thus, a downward force against the top of the box causes the intermediate sidewall living hinges to bow outwardly, allowing the cover to become flattened. Because the third sidewall is curved inward along the lines of curvature forming the living hinges at the top and bottom of the third sidewall, the sidewall will remain rigid and upright despite the application of a downward force against the top of the box cover. At some point, an increased force overcomes the natural support created by the curvature, causing the material to snap or pop as it flexes outward and folds at the intermediate living hinges. At that point, the cover can become substantially flattened for storage. The box cover and box may be flattened in an easier manner with less force by applying a central outward force on the curved sidewalls from within. This will cause the curved sidewalls to deform outwardly until the intermediate sidewall living hinges bow outwardly enough to fold (with a snap), allowing the cover or box to be flattened (i.e., collapsed).

Figure 1D:
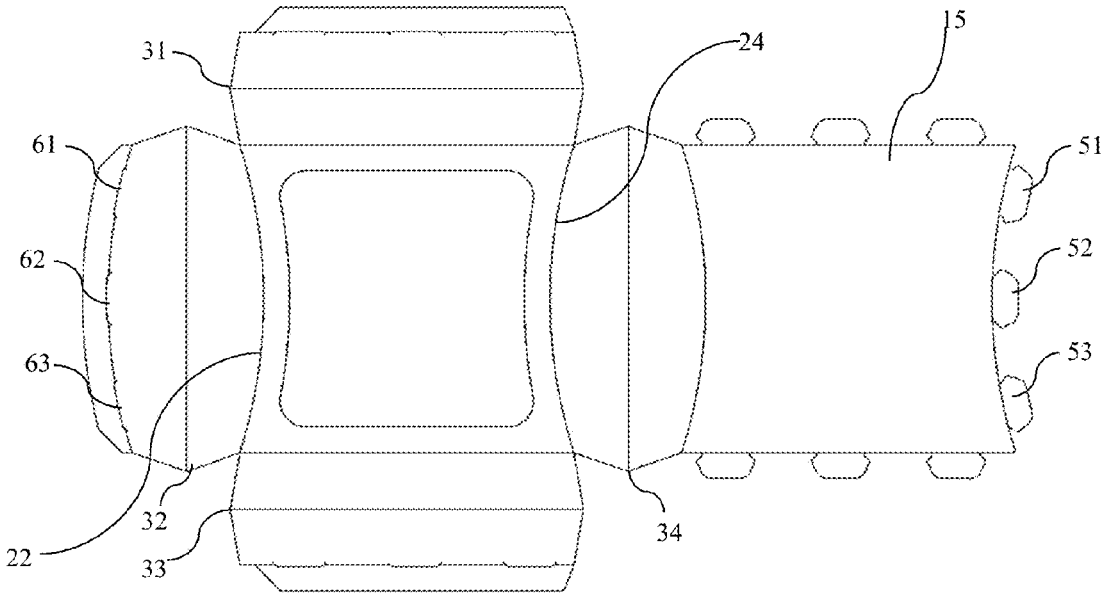
FIG. 1D is another plan view of an unassembled snap-fold container made in accordance with principles of the invention.
Figure 1E:
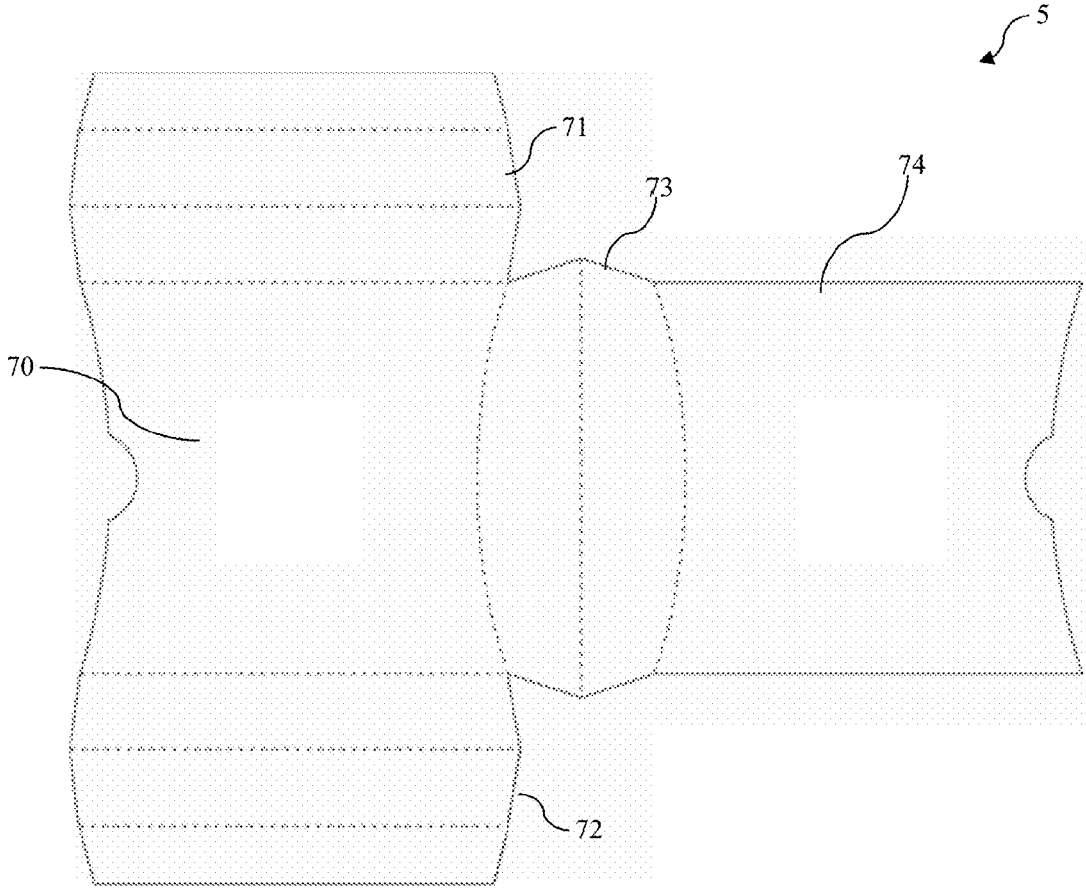
FIG. 1E is a plan view of an unassembled snap-fold cover made in accordance with principles of the invention.

In an alternate version of the slide box, the container may comprise two sliding covers constructed substantially as shown in FIG. 1D but without the box. In this version, a first open-sided cover is constructed as described above and a second open-sided cover is configured in the same way but sized to allow the second cover to be slideably received within the first cover. Thus, when the second cover is received within the first cover, the resulting container will be double-walled on four sides of the cubic rectangle and single-walled on two sides. Complementary concave and convex notches or other locking mechanisms may optionally be included to secure the covers to one another in the closed position.

Figure 2:
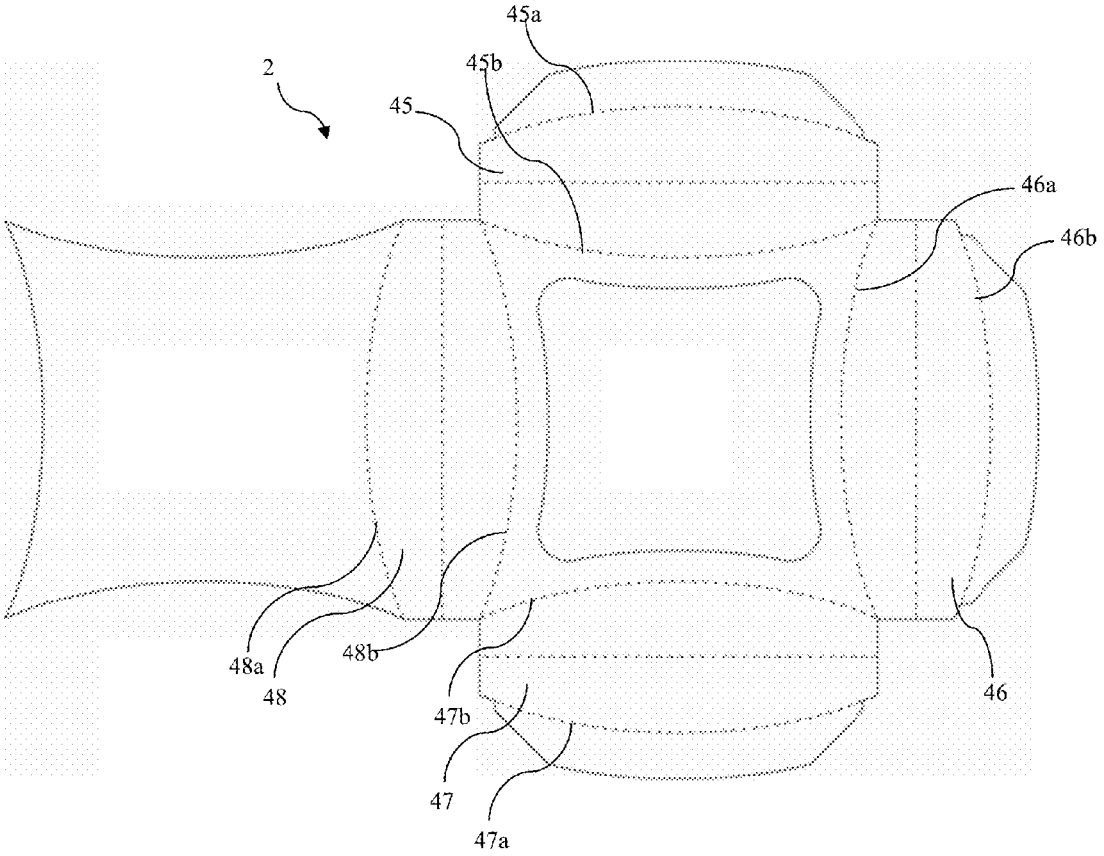
FIG. 2 is a plan view of an unassembled snap-fold X-box made in accordance with principles of the invention.

Additional versions of snap-fold containers are further illustrated below. In one version shown in FIG. 2, the container 2 is in the form of what is referred to as an "X-Box." This label is used principally because the box is somewhat formed as an X when viewed from the top. More specifically, all four of the sidewalls 45, 46, 47, and 48 are bowed inwardly from what otherwise would be a standard rectangular or square shape. As compared with the slide box, as described above with reference to FIGS. 1A through 1E, the principal difference with container 2 is that the upper and lower living hinges of the X-Box (respectively, 45*a*, 45*b*, 46*a*, 46*b*, 47*a*, 47*b*, 48*a*, and 48*b*) are all formed along lines of curvature, whereas with the slide box as described above with reference to FIGS. 1A through 1E, only one pair of opposing sidewalls had curved living hinges and the other pair of sidewalls has straight living hinges.

Figure 3:
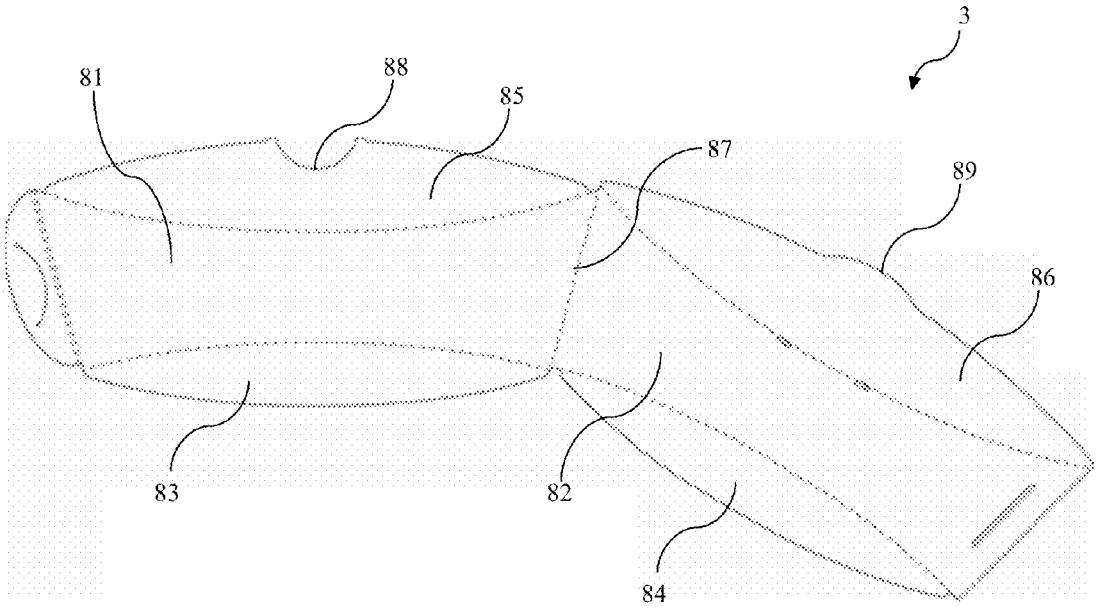
FIG. 3 is a plan view of an unassembled pen case or alternatively, sunglass case made in accordance with principles of the invention.

A further version of the invention is depicted in FIG. 3 and it is in the form of a case 3, labeled as a pen case but equally suitable for other purposes such as holding sunglasses or other eyewear. Two versions of such pen or eyewear cases are described below. In a first version, the case is formed initially from flat stock material as with the examples above. In this case, a case top 81 is formed adjacent a case bottom 82, with a straight living hinge 87 between them. In each case, the case top and bottom are formed with a generally rectangular shape, having straight-sided ends and long sides that are curved inward at the middle.

Each of the top and the bottom includes a first sidewall 83, 84 having opposing curved sides meeting at the same point to generally form a marquise or "football" shape. An opposing second sidewall is formed by a pair of similarly shaped panels 85, 86. In the case of the opposing sidewalls, a first panel may optionally include a scalloped, recessed portion 88 while the second panel includes an extending tab 89 to better allow a user to grasp the second panel and fold it downward.

The pen case is constructed into a three dimensional form from its initial flat configuration by first folding the living hinge 87 separating the top and bottom panels. The first sidewall is then formed by folding each of the curved panels along the curved living hinges separating the sidewalls from the top and bottom panels. The curvature of the living hinges will typically cause the plastic sheet material to snap or pop as it flexes into position. The opposite sidewalls will likewise be formed by folding them and snapping them into position. In one version of the case, an additional flap may be formed along either the top or the bottom (or both) and then joined to the opposite section by gluing, welding, inserting tabs, or other means.

Figure 4A:
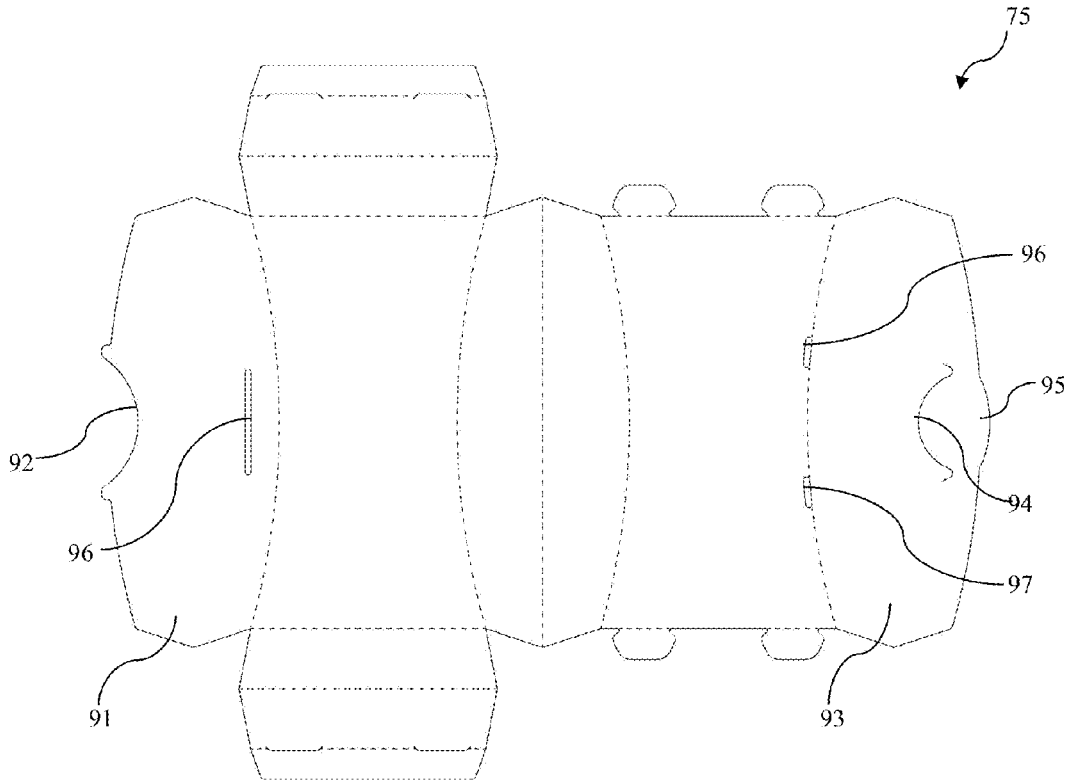
FIG. 4A is a plan view of an unassembled alternate pen case or alternatively, sunglass case made in accordance with principles of the invention.
Figure 4B:
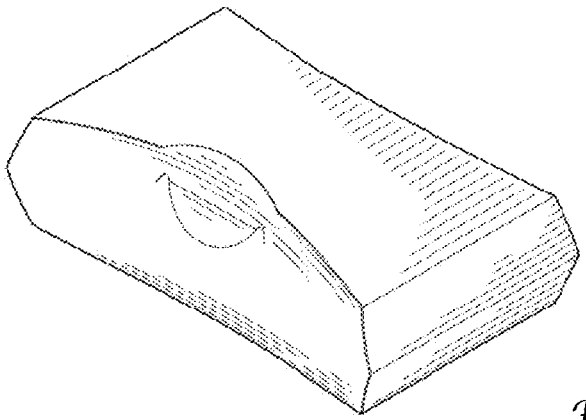
FIG. 4B is a perspective view of an assembled pen case in accordance with FIG. 4A.

In an alternate version shown in FIG. 4, another pen or sunglass case 75 is formed substantially as with the sliding box as described above. Thus, it includes a top, a bottom, and four sidewalls. Likewise, most preferably, a first pair of opposing sidewalls has straight sides (owing to a straight living hinge) and a second pair of opposing sidewalls has bowed sides (which is the result of curved living hinges).

One difference between this alternate pen case 75 and the sliding box 1 as described above with reference to FIGS. 1A to 1D (i.e., not including the cover 5) is that the pen case 75 does not include an open top, but rather forms a fully enclosed case. A further difference is that the pen case is intended to be opened along one sidewall. The sidewall that can open may be formed with tab and scallop features as described above with reference to FIG. 4 (elements 88 and 89), or may have different closure features. As illustrated, a first panel 91 forming the opening sidewall includes a peripheral inward scallop 92 having a pair of prongs, and a central slot 96. A second panel 93 forming the opening sidewall includes an outward tab 95 and a curved slit 94. A pair of openings 96, 97 are positioned along the living hinge separating the bottom panel from the second sidewall panel 93. When closing the sidewall, the first panel 91 is folded into position and then the second sidewall panel 93 is folded into position. The pair of prongs are received within the pair of openings 96, 97, while the outward tab 95 is received within the slot 96. This combination of features will securely hold the case 75 in the closed position. To open the case, the user grasps a portion of the tab 95 along the slit to remove it and pry open the sidewall.

Figure 5A:
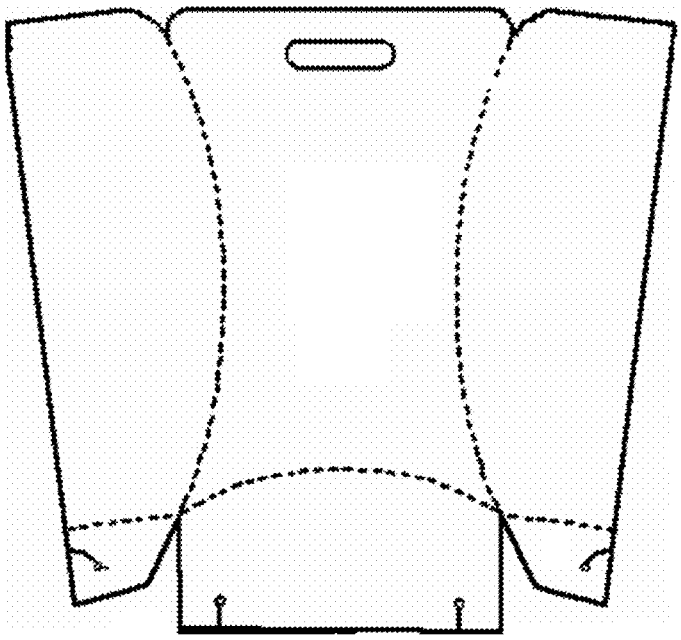
FIG. 5A is a plan view of an unassembled snap-fold waste bin made in accordance with principles of the invention.
Figure 5B:
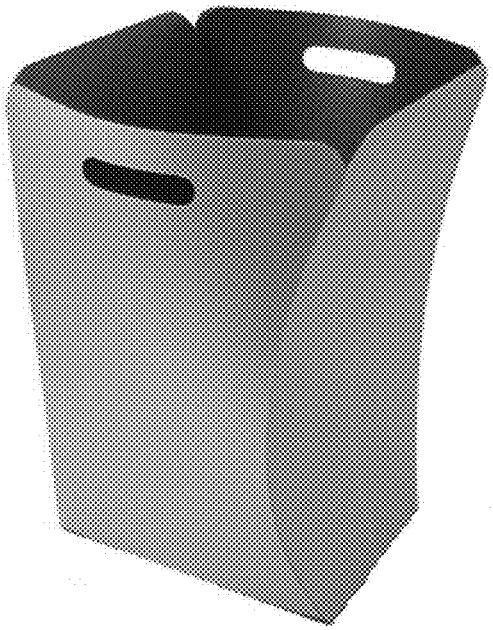
FIG. 5B is a perspective view of a snap-fold waste bin made in accordance with principles of the invention.

An additional version of the invention is illustrated in FIGS. 5A and 5B, in the form of a bin such as a wastebasket. As illustrated, in the plan view of a flattened bin in FIG. 5A and the perspective view of an expanded bin of FIG. 5B, the bin includes a pair of opposing sides formed with corners along a bowed path of curvature. The bottom also has straight edges on two opposing sides, and bowed edges along the other opposing sides.

A further version of the invention is illustrated in connection with FIGS. 6A to 6F below as a colander 100. As illustrated, the colander includes a plurality of through-holes 101 to allow for liquid to drain through the colander 100. The holes may be arranged differently to form a ventilated crate, or the same article may be formed without holes to create a box or crate for carrying or storing items.

Figure 6A:
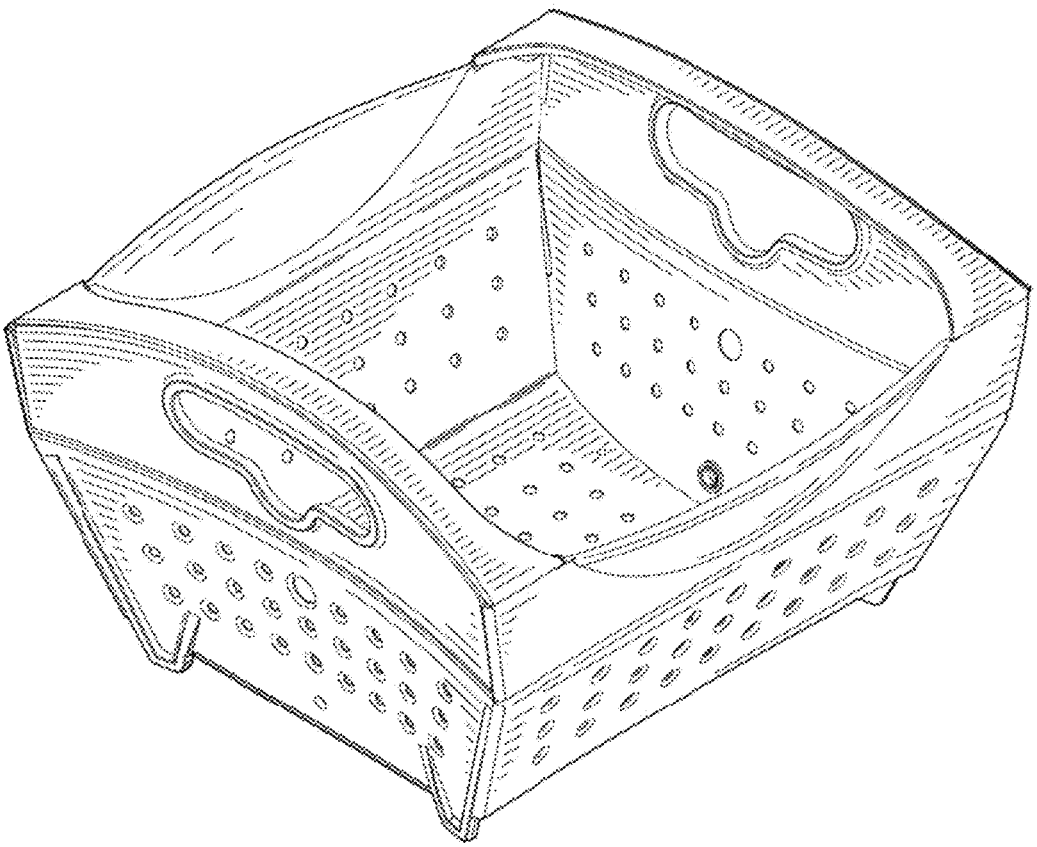
FIG. 6A is a perspective view of a snap-fold colander made in accordance with principles of the invention.
Figure 6B:
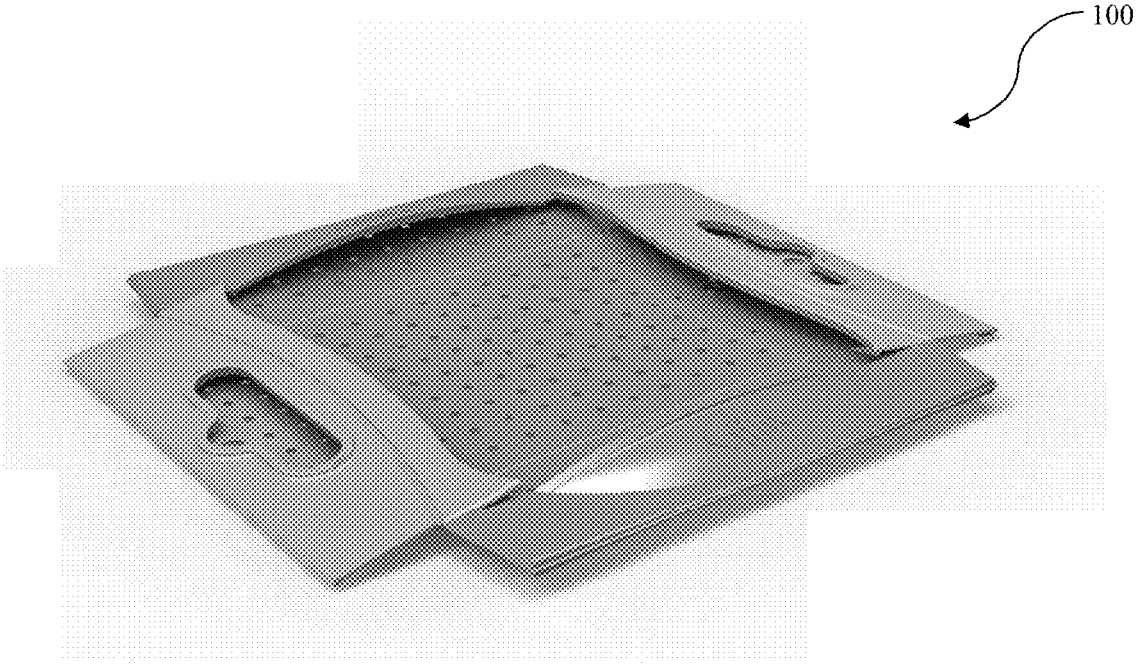
FIG. 6B is a perspective view of an unassembled (i.e., collapsed) snap-fold colander made in accordance with principles of the invention.
Figure 6C:
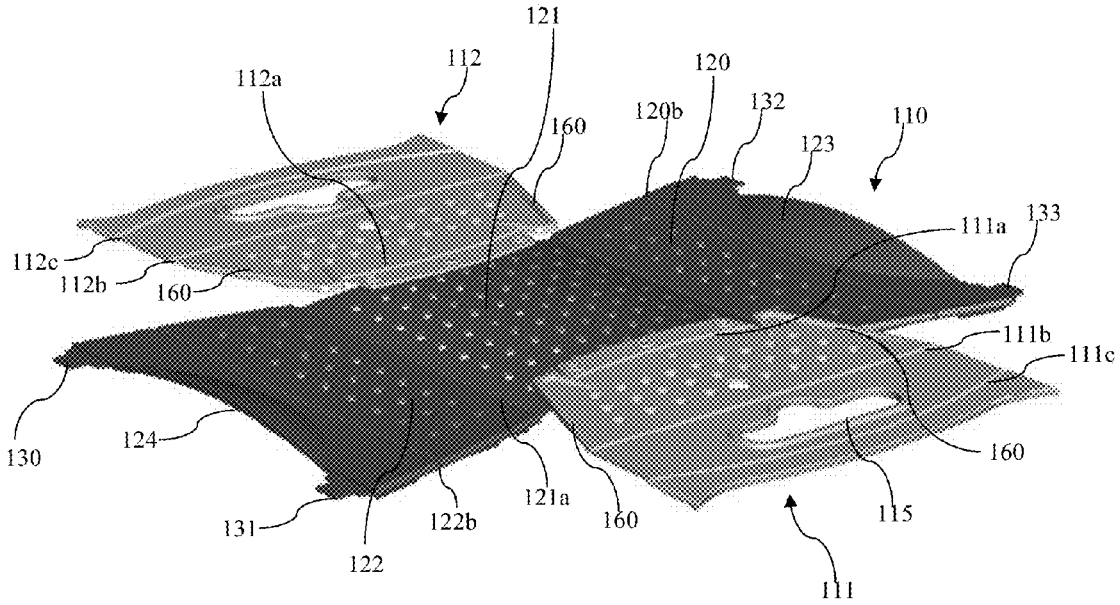
FIG. 6C is another perspective view of an unassembled (i.e., collapsed) snap-fold colander made in accordance with principles of the invention.

As shown best in FIG. 6C, the colander is preferably formed in three separate panels 110, 111, 112. The first panel 110 comprises separate sections that make up a floor 121 and a pair of opposing sidewalls 120, 122 of the crate. As shown, each of the floor and opposing sidewalls includes several through-holes for drainage. A second panel 111 attaches to the first panel, generally along an edge in the floor of the first panel. Similarly, a third panel 112 attaches to the first panel, generally along an opposite edge in the floor of the first panel. In this fashion the second and third panels (111 and 112) form a pair of opposing sidewalls which, together with the first pair of opposing sidewalls 120, 122, combine to form the four sidewalls of the generally rectangular cubic colander. As shown best in FIG. 6D (illustrating a close-up view of a cutaway of the flattened container of FIG. 6C), the second and third panels 111 and 112 may be attached to the first panel 110 using a series of rivets or by gluing, press-fitting, or other means. Preferably, plastic or stainless steel fastening components are used to avoid rusting.

Each of the panels described above includes integrally formed living hinges to allow the assembled colander to be expanded or collapsed, as desired. FIG. 6B shows the colander 100 in a collapsed position. As shown in FIG. 6C, the second and third panels each include a first living hinge 111*a*, 112*a* positioned along the location where the second and third panels are joined to the first panel. The second and third panels (elements 111 and 112, respectively) further include an intermediate living hinge 111*b*, 112*b* and an upper living hinge 111*c*, 112*c*. Preferably, a handle 115 is formed as a cutout region and positioned in the space between the intermediate and upper living hinges.

The first panel similarly includes several living hinges. The floor 121 of the first panel is defined by a pair of opposing edges (located where the second and third panels are attached) on two sides and by a pair of living hinges 120*a*, 122*a* defining the separation between the floor and the opposing sidewalls 120, 122 formed in the first panel. Each of the sidewalls 120, 122 includes an intermediate living hinge 120*b*, 122*b*. When the panels are attached and the colander or container is in the expanded position, the four intermediate living hinges, 120*b*, 122*b*, 111*b*, 112*b* are each positioned at the same height above the floor of the colander.

The side panels are configured to attach to one another at an upper location on the sidewalls. In one version, the first panel includes four tabs 130, 131, 132, 133, with a pair of the tabs located on each side of the first panel, each of the pairs extending generally outward and generally away from one another. The second and third panels each comprise a pair of complementary fastening locations for securing one of the four tabs to one of the four fastening locations. In one version, the tabs are secured to the second or third panels using rivets, snap-fit features, or the like. Most preferably, one or more mating ribs, notches, or other features is also provided to ensure that the tab cannot rotate at its point of attachment, and therefore the panels are attached to one another in a fixed fashion whereby they cannot rotate at the attachment point.

Figure 6D:
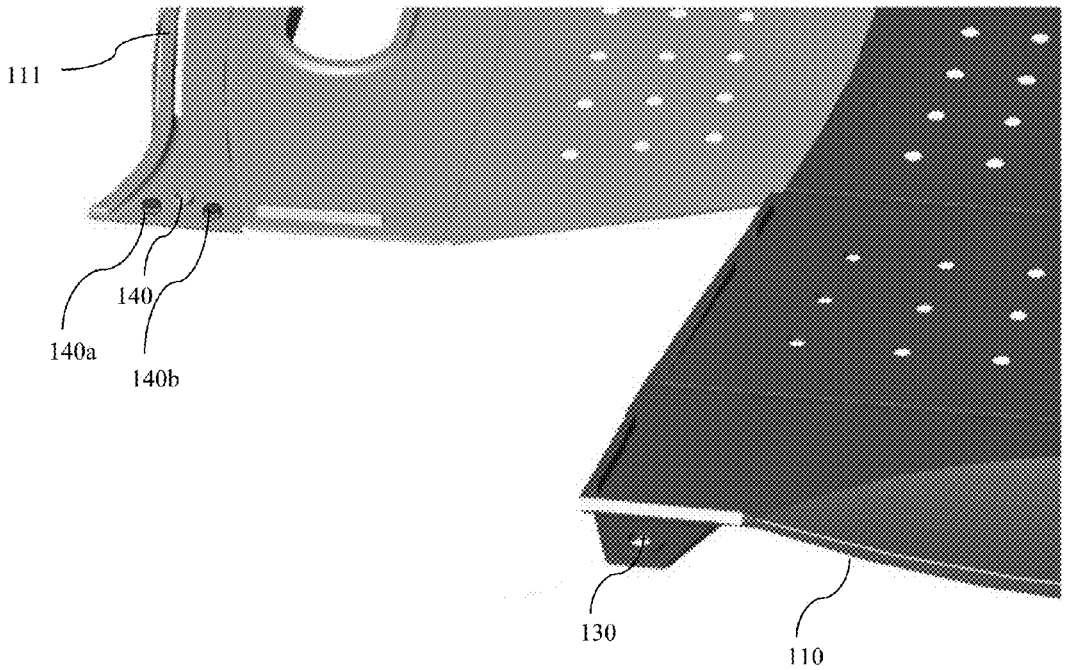
FIG. 6D is a detailed view of the tabs used for fastening a snap-fold colander made in accordance with principles of the invention.

For example, as shown in FIG. 6D (providing a partial cutaway view of portions of panels 110 and 111), in one version there is provided a snap fit fixture 140 sized to snap into and be received by a grommet or similar receptacle 130. Preferably, on either side of the snap fit fixture, two anti-rotational elements 140*a*, 140*b* are provided whereby the tabs 130, 131, 132, 133 are locked into place and prevented from moving rotationally relative to the radius of a corresponding snap fit fixture 140.

Each of the second and third panels 110 and 111 is formed with a pair of feet formed at the base, with the panel having a narrow base extending generally outward at an angle from each side as it extends upward such that the width at the intermediate living hinges 120*b* and 122*b* is greater than the width at the base. In the illustrated version shown best in FIG. 6C, the portion of the second and third sidewalls between the intermediate living hinges 120*b* and 122*b* and the upper living hinges 111*c* and 112*c* is of a substantially uniform width, such that the panel is formed with generally parallel sidewalls in that section. The upper living hinges 111*c* and 112*c* are formed along an arc following a radius of curvature. Thus, as seen best in FIG. 6F, the distance H1, H3 between the intermediate living hinge 112*b* and the upper living hinge 112*c* is smaller at each the outer edges of the side panels 112 (and 111) than the distance H2 is at a central location along the side panel 112 (and 111). Similarly, the lower living hinges 111*a*, 112*a* are formed along a curvature in which the curvature is oriented opposite that of the upper living hinges; in other words, while the upper living hinge 112*c* has an upward arc, the lower living hinge 112*a* has a downward arc. This combined shape of the panels and the orientation of the living hinges causes the side panels 111 and 112 to bow inward (along the path defined by the upper living hinges) when the colander is pressed into the assembled position. Conversely, the intermediate living hinges 112*b*, 111*b* are each formed along a straight line in a common plane, thereby allowing the colander to fold into a flat configuration when collapsed.

One or more ribs 160 may further be provided at desired locations on the panels to serve as stops to retain the edges of the panels adjacent one another in the expanded position. In one version, the first panel may include several ribs positioned to face into an interior of the colander in the expanded position and formed along edges of the sidewall portion of the first panel. When the colander is expanded and the edges of the sidewalls are urged toward one another, edges of the second and third panels abut the ribs to prevent the edges from being urged to an interior portion of the colander. Thus, the ribs can serve to align the colander and ensure the edges are retained closely adjacent one another.

Each of the first, second, and third panels includes an upper portion, above the upper living hinge. The upper portion includes a central region that terminates along a curved edge that follows a path of curvature parallel to that of the upper living hinge. Outer ends of the upper portion of the panels, however, flare outward to provide a wider engagement surface and a larger area of contact between adjacent panels, thereby providing greater structural rigidity in the expanded position.

Figure 6E:
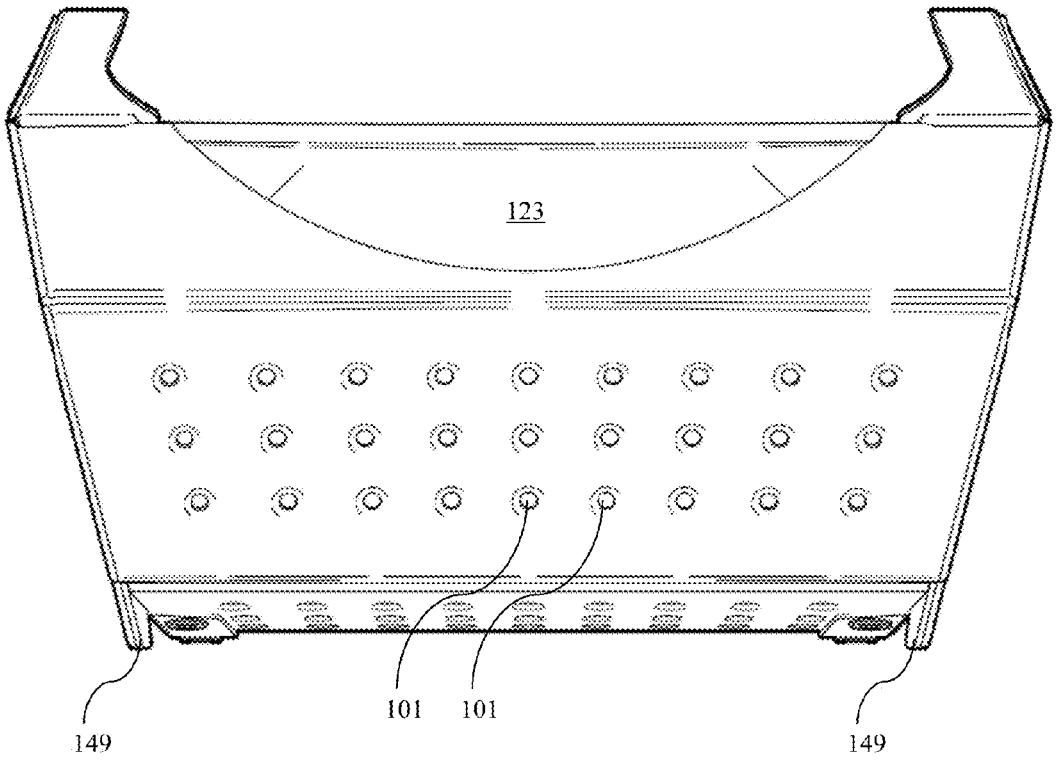
FIG. 6E is a side view of a snap-fold colander made in accordance with principles of the invention.
Figure 6F:
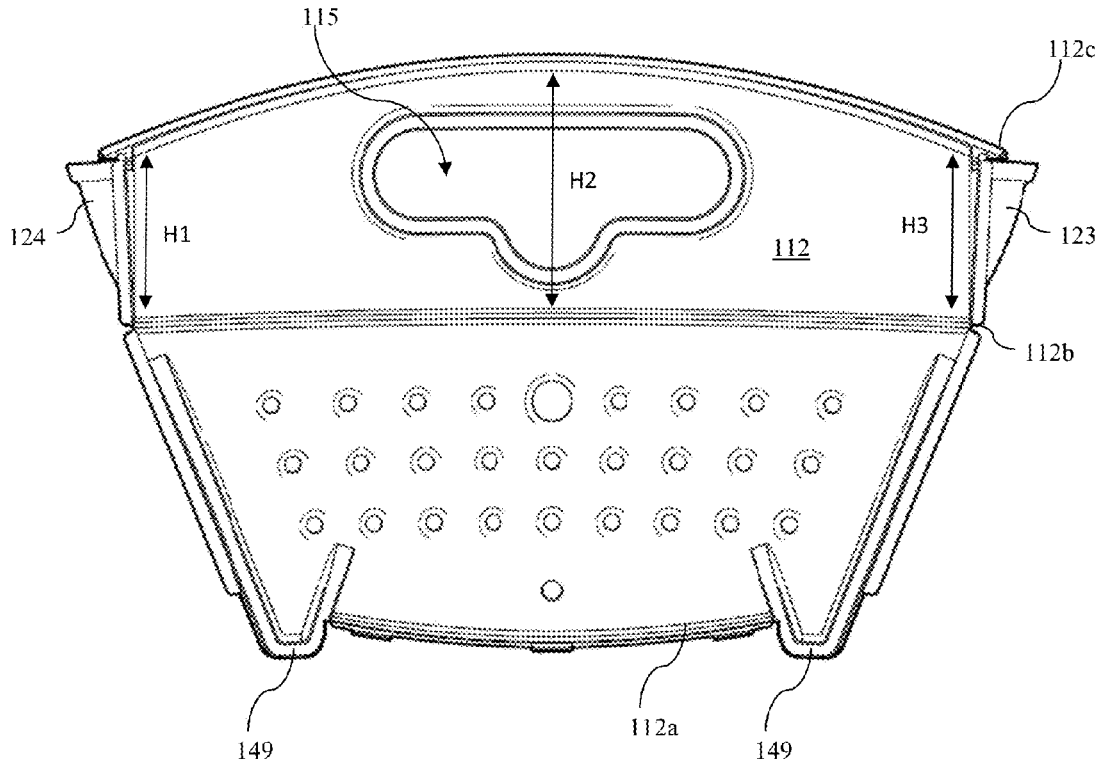
FIG. 6F is an end view of a snap-fold colander made in accordance with principles of the invention.

In the illustrated version, one or both of the upper ends of the sidewalls 120, 122, includes a spout 123, 124 to facilitate pouring items (such as pasta, after having been drained) from the colander. As shown in FIGS. 6E and 6F, the spout may be formed to bow outward along substantially the entire length of the sidewall of the colander.

The feet 149 formed in the second and third panels preferably extend below the lower living hinges 111*a*, 112*a*, thereby forming a foundation that will support the floor 121 of the colander above a horizontal surface such as a sink when the colander is expanded and in use. Most preferably, the feet include ribbing around the perimeter for greater strength.

In a preferred version, the products described above are formed from any suitable plastic material, with the separate panels being integrally molded with living hinges created as areas with thinned material making the living hinges more flexible.

Figure 7A:
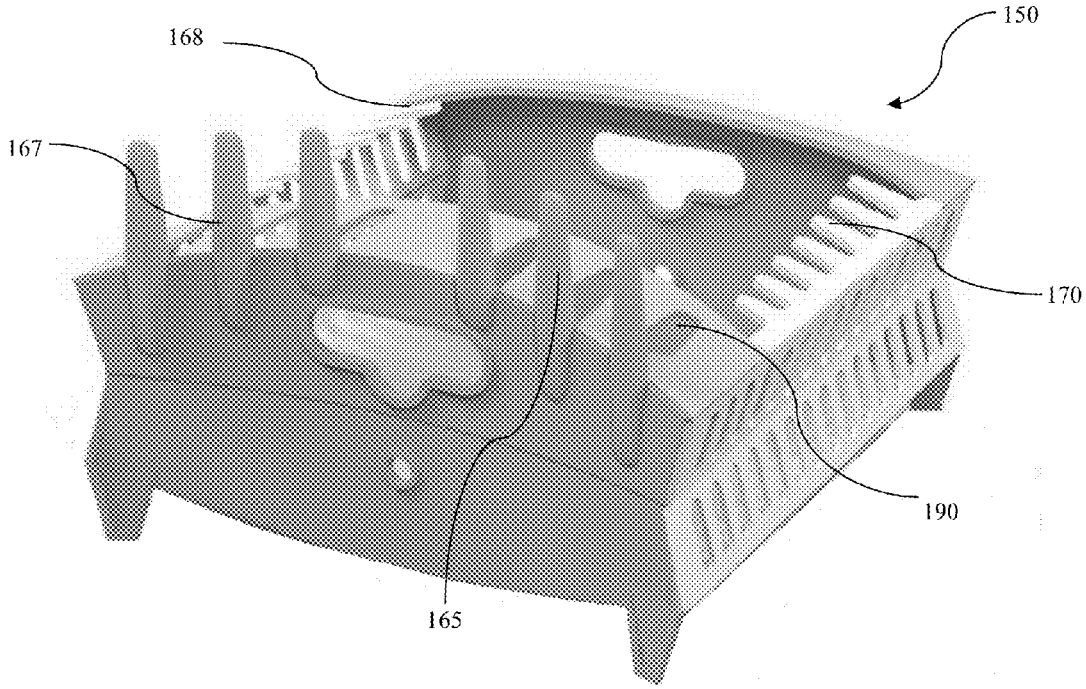
FIG. 7A is a perspective view of a snap-fold dish rack made in accordance with principles of the invention.
Figure 7B:
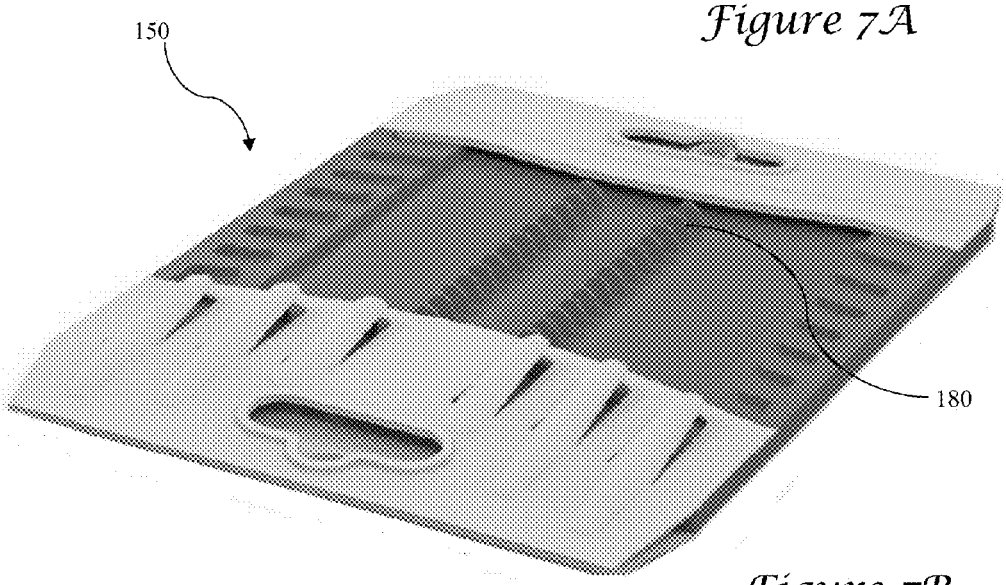
FIG. 7B is a perspective view of an unassembled (i.e., collapsed) snap-fold dish rack made in accordance with principles of the invention.
Figure 7C:
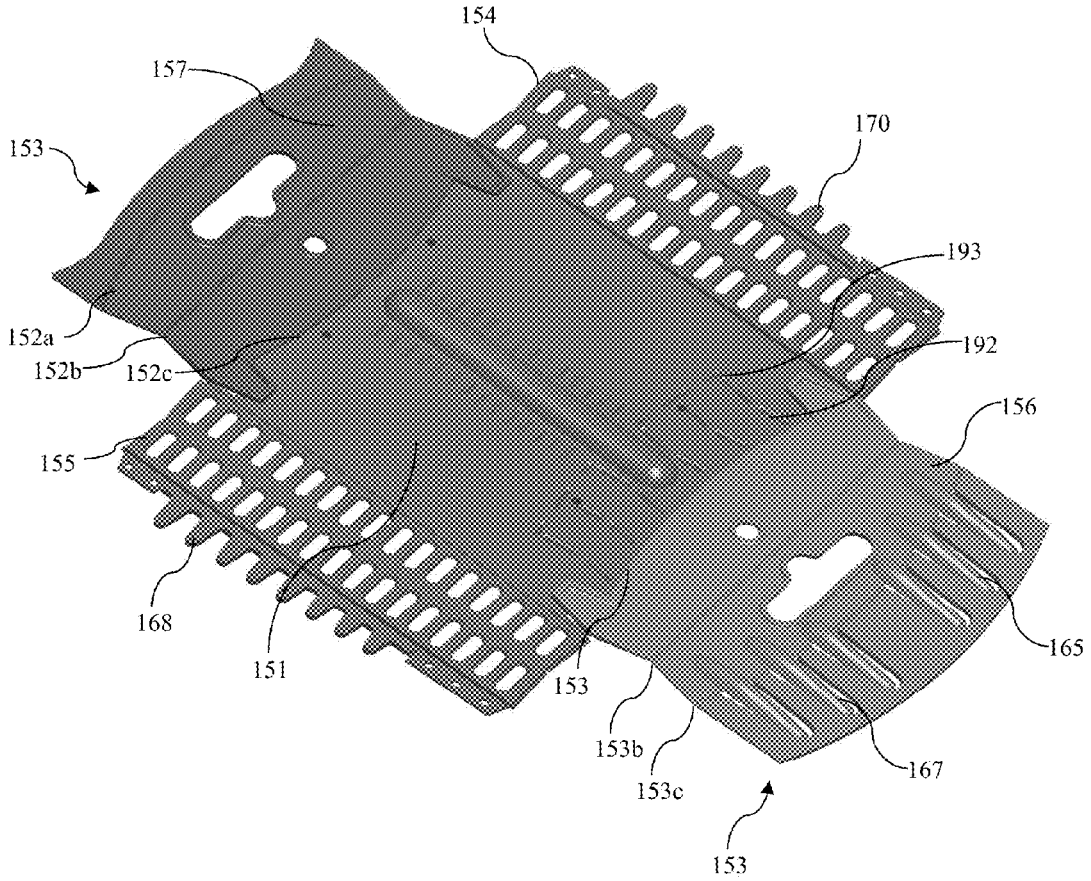
FIG. 7C is a plan view of an unassembled snap-fold dish rack made in accordance with principles of the invention.

Yet other versions of snap-fold containers made in accordance with principles of the invention are further illustrated in the FIGS. 7A through 7C. One version of the invention folds into a dish rack 150. As shown in FIG. 7C, the dish rack 150 is formed with three panels, 151, 152, 153, the panels being structurally similar to the colander as described above. Thus, a first panel 151 forms a floor and pair of opposing sidewalls 154 and 155 of the dish rack, while second and third panels 152, 153 are joined to the first panel to form a second pair of opposing sidewalls 156, 157.

As with the colander, the second and third panels each include three living hinges in which the intermediate living hinge, 152*b*, 153*b*, extends along a straight line while the upper and lower living hinges 152*a*, 153*a*, 152*c*, 153*c*, are bowed, with the lower living hinge being curved downward and the upper living hinge being bowed upward. The second and third panels are further formed with feet as described above.

In order to form the container into a dish rack, additional ribs, for example 168, 170 and extensions, for example 165, 167 are formed in the panels. Thus, the front panel is formed with several elongate cutouts 165, 167 that straddle the upper living hinge. When folded along the upper living hinge, these elongate cutouts extend vertically and provide locations for supporting cups or glasses. In addition, the space vacate by the cutouts 165, 167 to form posts for holding glasses also creates an opening 190 suitable for accepting cutlery. The cutlery can be inserted through the openings where it stands in an upright position, resting on the floor and leaning against the rim of the opening.

Similarly, the edges of the first panel are formed with a series of outwardly extending fingers 168, 170. When the dish rack 150 is assembled and in the expanded position, these fingers face toward one another; that is, they are formed on opposite sides of the container and project inwardly toward one another and toward the center of the container. Because the fingers are sized and configured to receive a plate between them, in the expanded position they can each provide support for a plate in a vertical position.

The floor of the first panel 151 is further formed with a series of upwardly extending ribs 180 with the ribs 180 being spaced apart to receive a rim of a plate and thereby provide support for plates placed between the ribs in a vertical position. The floor panel 151 may further include additional upward ribs or flanges 192, 193, formed to be positioned under the cutlery openings when the container is expanded. While the vertical portion of the elongate cutouts are useful for supporting cups and glasses, the openings in the cutouts are functional for receiving cutlery. This second ribbing is positioned along the floor of the first panel cooperate with the openings to prevent the cutlery from sliding downward and along the floor.

As shown in FIG. 7C, the dish rack begins in an entirely flat configuration. By attaching sides to one another, it progresses to the shape of FIG. 7B, in which it remains flattened but is assembled. Urging the opposing sides inward produces the expanded position of FIG. 7A.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A configurable container, comprising:

first, second, third, and fourth sidewalls, wherein the first sidewall is provided opposite the third sidewall and the second sidewall is provided opposite the fourth sidewall;

a floor integrally formed with at least one of the sidewalls;

the first, second, third, and fourth sidewalls being joined to the floor to form an interior space;

at least one of the sidewalls or the floor further comprising a plurality of through-holes formed in interior locations of the sidewall or the floor;

each of the sidewalls and the floor being formed from sheet material;

the first sidewall having a first lower living hinge extending along an interface of the floor and the first sidewall, and a first intermediate living hinge positioned between the first lower living hinge and an upper end of the first sidewall;

the second sidewall having a second lower living hinge extending along an interface of the floor and the second sidewall, and a second intermediate living hinge positioned between the second lower living hinge and an upper end of the second sidewall;

the third sidewall having a third lower living hinge extending along an interface of the floor and the third sidewall, and a third intermediate living hinge positioned between the third lower living hinge and an upper end of the third sidewall; and the fourth sidewall having a fourth lower living hinge extending along an interface of the floor and the fourth sidewall, and a fourth intermediate living hinge positioned between the fourth lower living hinge and an upper end of the fourth sidewall;

the first lower living hinge following a curved path and the third lower living hinge following a curved path, the second lower living hinge following a straight path and the fourth lower living hinge following a straight path;

whereby when the first, second, third, and fourth sidewalls are joined together to form an upper rim and the interior space, the container is selectively configurable between a first position in which the collapsible container is substantially flat, and a second position in which the collapsible container is expanded, the curved path of the first lower living hinge and the curved path of the third lower living hinge urging the first sidewall and the third sidewall toward the interior space when the container is in the second position.

2. The container of claim 1 wherein the container is constructed from first, second, and third sheets of material.

3. The container of claim 2 wherein each of the first, second, and third sheets of material are polymer plastic.

4. The container of claim 2 wherein the first and third sidewalls each comprise an upper rim, and at least one of the first and third sidewalls is formed to include a spout.

5. The container of claim 2 wherein the first sheet of material integrally forms the floor and the first and third sidewalls, the second sheet of material forms the second sidewall, and the third sheet of material forms the fourth sidewall.

6. The container of claim 1, further comprising at least a pair of handles formed in at least two of the first, second, third, and fourth sidewalls.

7. The container of claim 1 wherein the first sidewall further comprises a plurality of fingers formed in the first sidewall, the plurality of fingers lying in a plane defined by the first sidewall when the container is in the first position, the plurality of fingers extending angularly away from the first sidewall when the container is in the second position.

8. The container of claim 7 further comprising a plurality of openings formed adjacent the plurality of fingers.

9. The container of claim 1 wherein at least one sidewall further comprises a series of ribs, the ribs projecting inward into the interior space when the container is in the second position.

10. The container of claim 1 wherein the floor includes a series of ribs extending upward from the floor, the series of ribs being aligned in a row.

* * * * *